United States Patent [19]

Smith, Jr. et al.

[11] Patent Number: 4,657,077

[45] Date of Patent: Apr. 14, 1987

[54] LOCKING PRODUCTION SEAL ASSEMBLY

[75] Inventors: Sidney K. Smith, Jr.; John L. Baugh, both of Huntsville, Tex.

[73] Assignee: Hughes Tool Company, Houston, Tex.

[21] Appl. No.: 809,615

[22] Filed: Dec. 16, 1985

[51] Int. Cl.[4] ..... E21B 23/02

[52] U.S. Cl. ..... 166/115; 166/125; 166/136

[58] Field of Search ..... 166/115, 123, 125, 138, 166/181, 217

[56] References Cited

U.S. PATENT DOCUMENTS

| | | | |
|---|---|---|---|
| 2,862,560 | 12/1958 | Bostock et al. | 166/125 |
| 2,972,381 | 2/1961 | Raulins | 166/125 |
| 3,990,510 | 11/1976 | Decuir | 166/217 |
| 4,248,300 | 2/1981 | Braddick | 166/250 |
| 4,406,324 | 9/1983 | Baugh et al. | 166/125 |
| 4,482,014 | 11/1984 | Allwin | 166/136 |

OTHER PUBLICATIONS

TIW catalogue (1985), pp. 24–26.

*Primary Examiner*—Stephen J. Novosad
*Assistant Examiner*—Thuy M. Bui
*Attorney, Agent, or Firm*—Charles D. Gunter, Jr.

[57] ABSTRACT

A locking production seal assembly is shown for sealing a well tubing string within the bore of a surrounding well conduit which has been provided with an internal recess. The seal assembly includes a sliding mandrel which is made up in the well tubing string and an outer sleeve which is carried about the mandrel. The outer sleeve has an external seal for sealing with the interior of the surrounding conduit and an internal seal for sealing with the sliding mandrel. A setting sleeve carried between the mandrel and outer sleeve carries a set of setting dogs for engaging the surrounding conduit and a set of locking dogs for locking the setting sleeve to the surrounding sleeve once the assembly is set. The load carrying setting dogs are separated from the mandrel exterior by the setting sleeve to prevent damage to the mandrel exterior.

3 Claims, 8 Drawing Figures

LOCKING PRODUCTION SEAL ASSEMBLY

BACKGROUND OF THE INVENTION

1. Field of the Invention

The present invention relates to techniques for sealing cylindrical bodies to circumscribing conduits and, specifically, to an insert seal assembly for sealing a well tubing string within the bore of a surrounding well conduit.

2. Description of the Prior Art

Sealing devices of various kinds are used in well working operations, and in the production of a well. For example, in downhole cementing procedures, seal assemblies are used to control the placement of cement and the maintenance of pressure to accomplish cementing operations. Seal assemblies in the form of packers are known for isolating formations for treatment, or for isolating segments of liner or casing for squeeze cementing, for example. Packers are also used routinely for sealing production strings to liner or casing to define flow paths from producing formations to the surface.

In the case of production packers, the seal assemblies which are used to isolate the formations and define flow paths to the surface are set within a production casing or liner. The casing or liner is usually made up to include a sequence of tubular members threaded together. One of the tubular subs is provided with an internal recess, usually a circumferential groove, in proximity to a landing shoulder within the sub. The seal assembly is landed on the landing shoulder within the liner sub and has radially movable dogs which are actuated to latch the seal assembly into the internal recess provided in the pipe sub.

In prior seal assemblies of the above type, an outer sleeve was carried about a sliding inner mandrel. In certain of these tools, the latching dogs were driven radially outwardly into latching engagement with the recess provided in the surrounding liner. During production operations when pressure is on the tool, the latching dogs were subjected to loads which could damage the exterior surface of the sliding mandrel. The damaged mandrel could, in turn, damage that portion of the seal assembly used to seal between the mandrel and the surrounding conduit.

The present invention has as its object the provision of a seal assembly with an outer sleeve and inner sliding mandrel which includes an unique internal sliding sleeve that supports the setting dogs to prevent damage to the exterior surface of the sliding mandrel during production operations.

SUMMARY OF THE INVENTION

The locking production seal assembly of the invention is used for sealing a well tubing string within the bore of a surrounding well conduit which is provided with an internal recess for engagement by the production seal assembly. The production seal assembly includes a sliding mandrel which has an interior bore for conducting well bore fluids, an exterior, and upper connecting means for connection in a well tubing string leading to the well surface. An outer sleeve is carried about the mandrel and has an external seal region for sealingly engaging the interior bore of the surrounding well conduit and an internal seal region for sealingly engaing the mandrel exterior. The outer sleeve is provided with a plurality of openings at one circumferential location and with an internal recess at another circumferential location. A setting sleeve is provided which has an exterior surface with a plurality of windows formed therein.

Setting means are carried on a profile formed in the exterior surface of the setting sleeve. The setting means are movable radially outwardly through the openings in the outer sleeve for engaging the internal recess of the surrouding well conduit upon intial downward movement of the mandrel and the setting sleeve. Locking means are also carried by the setting sleeve below the setting means. The locking means are movable radially outwardly for engaging the internal recess provided in the outer sleeve upon continued downward movement of the mandrel and the setting sleeve.

Preferably the setting means are setting dogs which have camming surfaces adapted to be engaged by mating camming surfaces of the setting sleeve upon initial downward movement of the mandrel and the setting sleeve to move the setting dogs radially outwardly through the openings in the outer sleeve and into engagement with the internal recess of the surrounding well conduit. Preferably the locking means are locking dogs which are carried in the setting sleeve windows. The locking dogs are provided with camming surfaces which are adapted to be engaged by a camming surface provided in the exterior of the mandrel upon continued downward movement of the mandrel and setting sleeve to move the locking dogs radially outwardly into engagement with the internal recess provided in the outer sleeve.

Additional objects, features and advantages will be apparent in the written description which follows.

DETAILED DESCRIPTION OF THE INVENTION

Figure 1A:
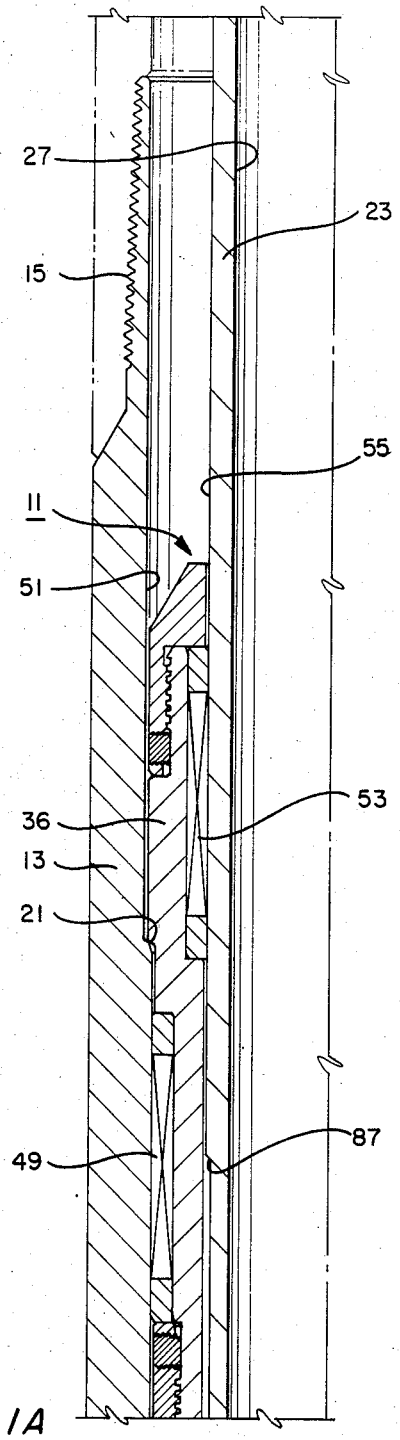
FIG. 1A is a side, partial cross-sectional view of the upper portion of a production seal assembly of the invention run into position within a well liner.

FIG. 1A shows the upper portion of a locking production seal assembly of the invention designated generally as 11. The seal assembly 11 is shown run into position within a surrounding well conduit, in this case liner 13. It should be understood that the liner 13 is a tubular conduit having an upper threaded extent 15 and a lower threaded extent 17 (FIG. 1B) by which a sequence of such tubular members are threaded together to make up a liner string (shown in dotted lines in FIGS. 1A and 1B).

Prior to running the seal assembly 11 into position, the liner is run into position within the well bore and "hung." The liner is then typically cemented in place and the running tool is removed. These operations are familar to those skilled in the art. When it is desired to produce from the well bore, or conduct workover operations, the seal assembly 11 is run into position on a tubing string extending to the well surface.

The liner 13 includes at least one section which is provided with an internal recess, in this case circumferential groove 19, for engagement by the seal assembly 11. The liner sub is also provided with an internal landing shoulder 21 which supports the seal assembly 11 upon running the seal assembly into position, as shown in FIG. 1A.

The seal assembly 11 includes a sliding tubular mandrel 23 which includes upper connecting means which can be identical to but oppositely arranged from the lower connecting means 25 (FIG. 1B) for connecting the mandrel in a tubing string extending upwardly to the well surface. The mandrel is also provided with an internal bore 27 for conducting well bore fluids which enter the liner below the seal assembly. The lower end 29 forms an external support shoulder 31 when connected to the remainder of the mandrel 23 for supporting the seal assembly in the running-in position. The mandrel exterior is also provided with a region of reduced external diameter 33 spaced-apart from the external shoulder 31.

Figure 1B:
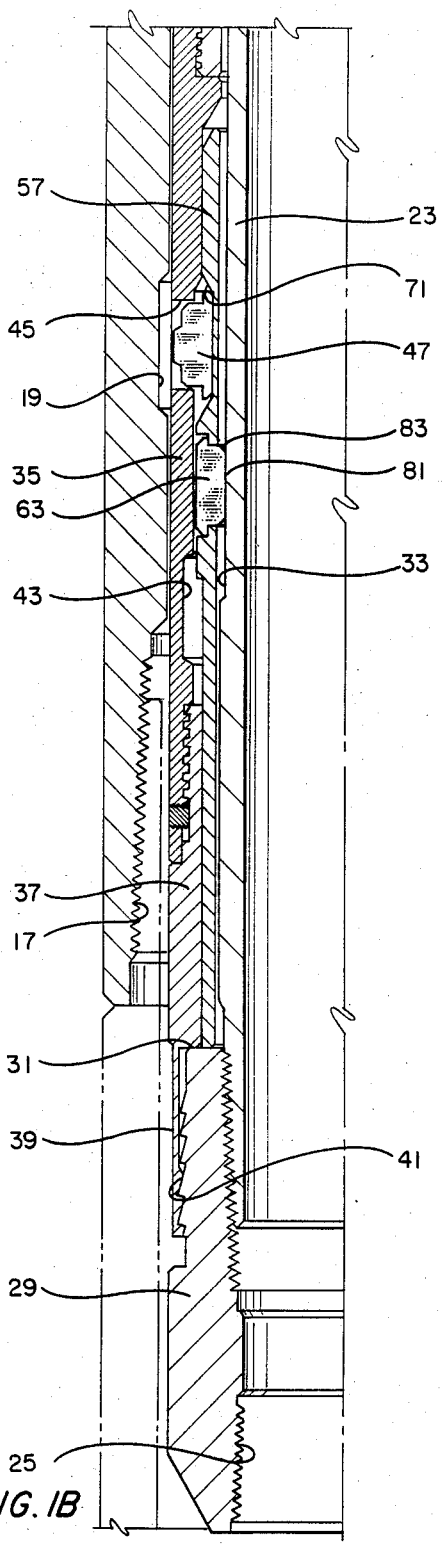
FIG. 1B is a downward continuation of FIG. 1A showing the lower portion of the seal assembly of the invention.

An outer sleeve 35 is carried about the mandrel 23 on the support shoulder 31 while running into the well bore. The sleeve 35, as shown in FIG. 1B, terminates in a collet body 37 having a plurality of downwardly extending collet fingers 39. The mandrel lower end 29 is provided with a serrated outer surface 41 which ratchets down the collet fingers 39 as the mandrel is moved downwardly with respect to the outer sleeve 35.

The outer sleeve 35 is provided with an internal recess, in this case annular groove 43. The sleeve 35 is also provided with a plurality of openings 45 for receiving setting dogs 47. Four or more evenly spaced openings are preferably provided at one circumferential location in the outer sleeve 35. The outer sleeve 35 is provided with an external seal region including packing 49 for sealing against the surrounding bore 51 of the well conduit, in this case liner 13. The outer sleeve 35 also has an internal seal region including packing 53 for sealingly engaging the mandrel exterior 55.

Figure 3:
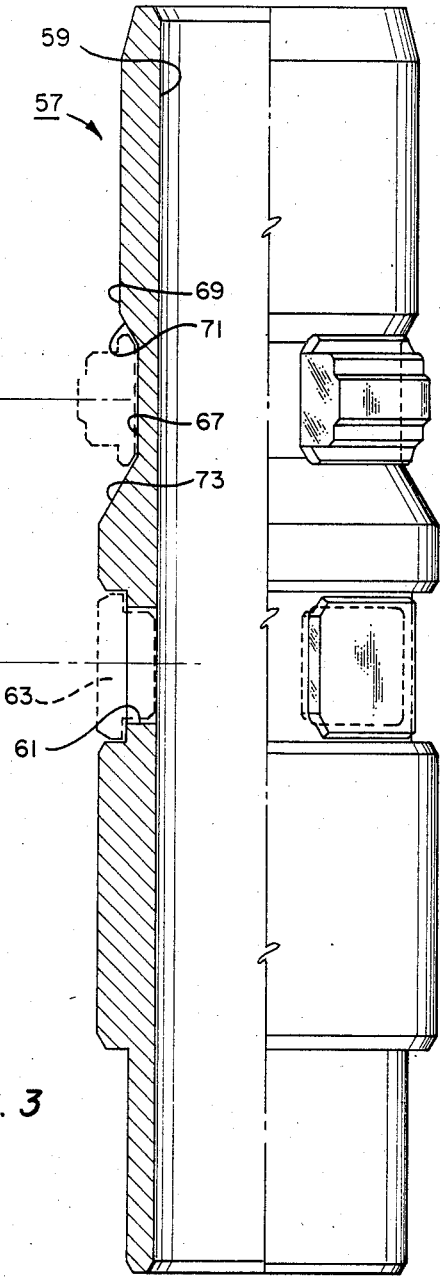
FIG. 3 is an isolated view, partially in section, of the sliding sleeve of the seal assembly of the invention.

A setting sleeve 57 is carried about the mandrel 23 between the outer sleeve 35 and the mandrel exterior 55, as shown in FIG. 1B. As best seen in FIG. 3, the setting sleeve 57 has a cylindrical interior 59 and is provided with a plurality of windows 61 for receiving a plurality of locking dogs 63. Four or more windows 61 are preferably provided, evenly spaced at one circumferential location about the setting sleeve 57. The locking dogs 63 can be provided with a stepped rear profile 65 so that they are retained within the window 61 in the position shown but cannot fall within the interior 59 of the sleeve 57.

The setting dogs 47 are carried on a profile 67 formed in the exterior surface 69 of the setting sleeve 57. The profile 67 is a circumferential groove having upper and lower tapered surfaces 71, 73, respectively, for engaging mating surfaces 75, 77, on the setting dogs 47 upon axial movement of the setting sleeve 57. The surface 71 tapers more steeply than the surface 73 and forms a camming surface for engaging the mating camming surface 75 on the setting dog 47. Downward axial travel of the setting sleeve 57 results in outward radial movement of the setting dogs 47 through the openings 45 in the outer sleeve 35 so that the exterior surface 79 of the dogs 47 is received within the groove 19 in the surrounding well conduit.

Figure 5:
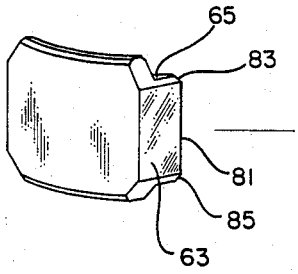
FIG. 5 is an isolated view of a locking dog carried by the sliding sleeve of FIG. 3.

The locking dogs 63 also have a rear surface 81 with upper and lower camming surfaces 83, 85 (Fig.5). As shown in FIG. 1B, the mandrel region of reduced external diameter 33 initially underlies the rear surface 81 of the locking dogs 63. Downward axial travel of the mandrel 23 causes the upper camming surface 87 of the mandrel to contact the camming surface 83 of the locking dog.

The operation of the seal assembly of the invention will now be described. The seal assembly 11 is run into the position shown in FIG. 1A with the assembly supported upon the support shoulder 31 of the mandrel lower end 29. As the upper extent 36 of the outer sleeve contacts the landing shoulder 21 within the surrounding conduit, further downward movement of the outer sleeve 35 is prevented. The serrated surface 41 of the lower end 29 then ratchets down the collet fingers 39 of the outer sleeve as the mandrel 23 continues to move downwardly.

As the camming surface 87 of the mandrel contacts the surface 83 of the locking dogs, the setting sleeve 57 is moved axially downwardly. As the setting sleeve 57 begins to move downwardly, the upper camming surface 71 contacts the mating camming surface 75 of the setting dogs 47, thereby resulting in outward radial travel of the setting dogs into the internal recess 19 provided within the liner 13. This action locks the outer sleeve 35 within the liner 13 and removes any loading from the setting sleeve 57 and locking dogs 63. The locking dogs 63 undergo a downward axial movement, followed by outward radial movement as the annular groove 43 within the outer sleeve 35 is encountered.

Figure 2A:
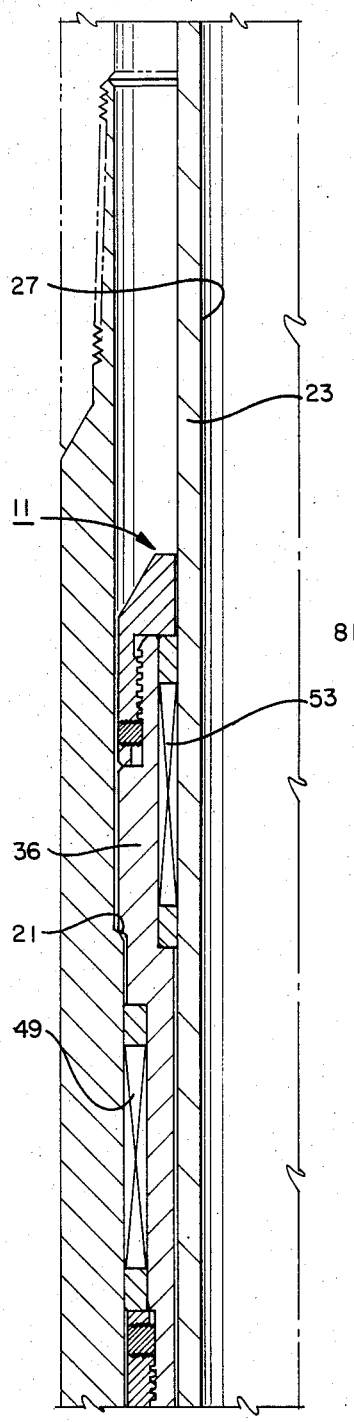
FIG. 2A is a side, partial cross-sectional view of the seal assembly of FIG. 1A showing the setting operation of the assembly.
Figure 2B:
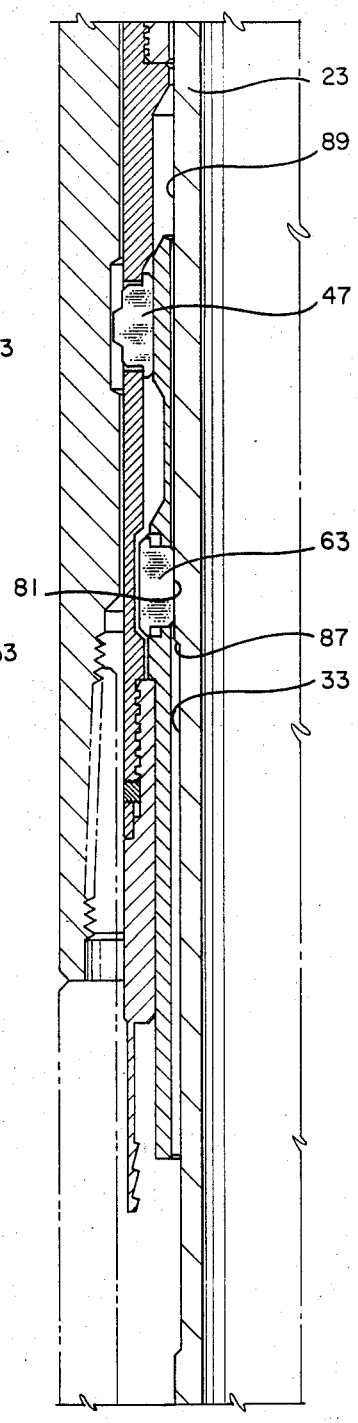
FIG. 2B is a downward continuation of FIG. 2A showing the assembly in the set position.
Figure 2C:
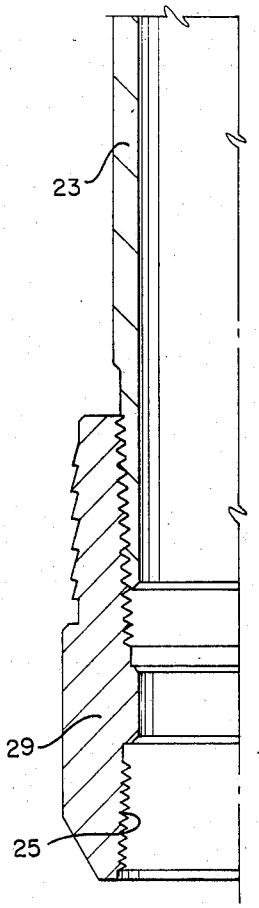
FIG. 2C is a downward continuation of FIG. 2B.
Figure 4:
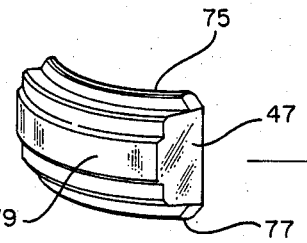
FIG. 4 is an isolated view of a setting dog carried by the sleeve of FIG. 3.

The seal assembly is shown in the "set" or "latched" position in FIGS. 2A–2C. In the set position shown in FIGS. 2A–2C, the mandrel region of reduced external diameter 33 has passed beneath the rear surface 81 of the locking dogs 63 and the remaining external diameter 89 of the mandrel 23 restricts inward radial movement of the dogs 63.

The sliding mandrel 23 can be provided with a "stroke" of 20 feet or more. The sliding stroke of the mandrel permits the attached tubing string to lengthen or shorten due to temperature and pressure changes within the well bore. In the set position shown, the locking dogs 63 lock the setting sleeve within the groove 43 of the outer sleeve 35 and prevent upward travel of the setting sleeve. Thus, as long as the external region of reduced diameter 33 of the mandrel does not underlie the rear surface 81 of the locking dogs 63, the assembly is locked in place and cannot be moved upwardly.

The assembly can be released by pulling the mandrel 23 upwardly to allow the region 33 to underlie the locking dogs 63. As the external shoulder 31 of the mandrel picks up the setting sleeve 57, the locking dogs 63 move radially inwardly and the setting sleeve moves axially upwardly. The setting dogs 47 are then retracted to the position shown in FIG. 1B and the seal assembly can be retrieved to the well surface.

An invention has been provided with several advantages. The seal assembly of the invention is simple in design and reliable in operation. A first set of radially moving dogs engages the seal assembly within a recess provided in the surrounding well conduit to insure the integrity of the seal between the assembly and the surrounding conduit. The load carrying, setting dogs are separated from the sliding mandrel by a setting sleeve which prevents damage to the mandrel exterior surface. A second set of locking dogs, carried by the setting sleeve, locks the setting sleeve to the outer sleeve of the seal assembly to prevent disengagement of the assembly.

While the invention has been shown in only one of its forms, it is not thus limited but is susceptible to various changes and modifications without departing from the spirit thereof.

We claim:

1. A locking production seal assembly for sealing a well tubing string within the bore of a surrounding well conduit, the surrounding conduit being provided with an internal recess for engagement by the seal assembly, comprising:

a mandrel having an interior bore for conducting well bore fluids, in exterior, and upper connecting means for connection in a well tubing string leading to the well surface, and a lower end, the lower end being connected to the remainder of the mandrel to form an external support shoulder, and wherein the mandrel exterior has a region of reduced external diameter which defines an upper and lower shoulder in the mandrel exterior adjacent the lower end;

an outer sleeve carried about the mandrel on the support shoulder while running into the well bore, the outer sleeve having an external seal region for sealingly engaging the interior bore of the surrounding well conduit and an internal seal region for sealingly engaging the mandrel exterior, the outer sleeve being provided with a plurality of openings at one circumferential location and with an internal recess at another circumferential location and the outer sleeve being provided with an external shoulder for engaging an internal landing shoulder provided in the surrounding well conduit;

a setting sleeve having an exterior surface with a plurality of windows formed therein, the setting sleeve being initially carried about the mandrel between the mandrel exterior and the outer sleeve with the region of reduced external diameter of the mandrel underlying the setting sleeve;

a plurality of setting dogs carried on a profile formed in the exterior surface of the setting sleeve, the setting dogs having upper camming surfaces adapted to be engaged by mating camming surfaces of the setting sleeve upon initial downward movement of the mandrel and the setting sleeve to move the setting dogs radially outwardly through the openings in the outer sleeve and into engagement with the internal recess of the surrounding well conduit; and a plurality of locking dogs carried in the setting sleeve windows, the locking dogs having upper camming surfaces adapted to be engaged by the upper shoulder formed in the mandrel exterior for downward longitudinal movement upon initial downward movement of the mandrel and for outward radial movement upon continued downward movement of the mandrel and setting sleeve to move the locking dogs radially outwardly into engagement with the internal recess provided in the outer sleeve.

2. A locking production seal assembly for sealing a well tubing string within the bore of a surrounding well conduit, the surrounding conduit being provided with an internal recess for engagement by the seal assembly, comprising:

a mandrel having an interior bore for conducting well bore fluids, an upper end with upper connecting means for connection in a well tubing string leading to the well surface, and a lower end, the lower end being connected to the remainder of the mandrel to form an external support shoulder, and wherein the mandrel exterior has a region of reduced external diameter which defines an upper and lower shoulder in the mandrel exterior adjacent the lower end;

an outer sleeve carried about the mandrel on the support shoulder while running into the well bore, the outer sleeve having an external seal region for sealingly engaging the interior bore of the surrouding well conduit and an internal seal region for sealingly engaging the mandrel exterior, the outer sleeve being provided with a plurality of openings at one circumferential location and with an internal recess at another circumferential location, and the outer sleeve being provided with an external shoulder for engaging an internal landing shoulder provided in the surrounding well conduit;

a rigid setting sleeve having a solid cylindrical lowe extent and having an exterior surface with a plurality of windows formed therein, the setting sleeve being initially carried about the mandrel between the mandrel exterior and the outer sleeve with the region of reduced external diameter of the mandrel underlyig the setting sleeve;

a plurality of setting dogs carried on a profile formed in the exterior surface of the setting sleeve, the setting dogs having upper camming surfaces adapted to be engaged by mating camming surfaces of the setting sleeve upon initial downward movement of the mandrel and the setting sleeve to move the setting dogs radially outwardly through the openings in the outer sleeve and into engagement with the internal recess of the surrounding well conduit; and a plurality of locking dogs carried in the setting sleeve windows, the locking dogs having upper camming surfaces adapted to be engaged by the upper shoulder formed in the mandrel exterior for downward longitudinal movement upon initial downward movement of the mandrel and for outward radial movement upon continued downward movement of the mandrel and setting sleeve to move the locking dogs radially outwardly into engagement with the internal recess provided in the outer sleeve.

3. The seal assembly of claim 2, wherein the outer sleeve terminates in a collet body having a plurality of downwardly extending collet fingers, and wherein the mandrel lower end has a serrated outer surface which ratchets down the collet fingers as the mandrel is moved downwardly with respect to the outer sleeve.

* * * * *